US011620967B2

(12) United States Patent
Beach

(10) Patent No.: US 11,620,967 B2
(45) Date of Patent: Apr. 4, 2023

(54) IMAGE PROCESSING DEVICE AND METHOD

(71) Applicant: Lewis S. Beach, Bel Air, MD (US)

(72) Inventor: Lewis S. Beach, Bel Air, MD (US)

( * ) Notice: Subject to any disclaimer, the term of this patent is extended or adjusted under 35 U.S.C. 154(b) by 171 days.

(21) Appl. No.: 17/201,309

(22) Filed: Mar. 15, 2021

(65) Prior Publication Data

US 2021/0287632 A1 Sep. 16, 2021

Related U.S. Application Data

(60) Provisional application No. 62/989,925, filed on Mar. 16, 2020.

(51) Int. Cl.
*G09G 5/377* (2006.01)
*G09G 5/02* (2006.01)

(52) U.S. Cl.
CPC ..... *G09G 5/377* (2013.01); *G09G 5/026* (2013.01); *G09G 2320/066* (2013.01); *G09G 2320/0666* (2013.01); *G09G 2340/12* (2013.01); *G09G 2360/18* (2013.01)

(58) Field of Classification Search
CPC ..... G09G 5/39; G09G 5/377; G09G 5/026; G09G 2320/066; G09G 2320/0666; G09G 2340/12; G09G 2360/18; G06T 2207/20032; G06T 7/44; G06T 2207/20192
See application file for complete search history.

(56) References Cited

U.S. PATENT DOCUMENTS 6,803,968 B1 * 10/2004 Numata ..... H04N 9/74 375/E7.137
10,019,737 B2 * 7/2018 Beach ..... G09G 5/377
2003/0048282 A1 * 3/2003 Grindstaff ..... G06T 7/33 345/629

FOREIGN PATENT DOCUMENTS

WO WO-2017189039 A1 * 11/2017

* cited by examiner

*Primary Examiner* — Antonio A Caschera
(74) *Attorney, Agent, or Firm* — WHDA, LLP

(57) ABSTRACT

An image processing device having a processor coupled to a memory. The processor is programmed to process two or more media formats stored in the memory, each media format is made up of one or more digital image layers that includes non-transparent pixels and may include transparent pixels. The processor is programmed to: set the non-transparent pixels in each of the digital image layer of the two or more media formats to a contrast state, set pixels stored in an off-screen data buffer of the memory to pixels corresponding to a predetermined color scheme, apply an image function to each media format that is drawn to the off-screen data buffer so as to allow the plurality of overlapping media formats to be displayed on the display screen as see through.

23 Claims, 18 Drawing Sheets

IMAGE PROCESSING DEVICE AND METHOD

CROSS-REFERENCE TO RELATED APPLICATION

This application claims the benefit of U.S. Provisional Patent Application No. 62/989,925, filed Mar. 16, 2020, which is incorporated by reference herein in its entirety.

TECHNICAL FIELD

The invention relates a new and innovative image processing device and method for generating and displaying more than one media context concurrently (that is, overlapping) with another media context.

BACKGROUND INFORMATION

The following descriptions set forth the inventors' knowledge of related art and problems therein and should not be construed as an admission of knowledge of the prior art.

Electronic applications such as games, weather apps, and social networking apps have shared resources with advertisements for many years. One of the standard modes of sharing resources involves subdividing the display resources and allocating some of the display resources to the application and some of the display resources to advertisements. An example of subdividing display resources is banner advertising. As illustrated in FIG. 1, typically a top or bottom fraction of the display 1 is allocated to a banner advertisement 2 and the rest of the display is allocated to an application 3. This approach restricts the size of the advertisement and reduces the display resources allocated to the application. In this approach the display resource is shared between an application and an advertisement. Some studies show that banner advertisements are easily ignored as users focus their attention on the application. Another standard mode of resource sharing involves taking turns using the display. An example of taking turns using the display is the typical interstitial advertisement. FIG. 2A, FIG. 2B and FIG. 2C together illustrate an example of interstitial advertisement. FIG. 2A shows an example of this approach allocating the entire display 1 to an application 3 until some pause in the application, i.e. when the next level in a game is reached. FIG. 2B shows an example of this approach allocating the entire display 1 to an interstitial advertisement 4 during a pause in the application. When the advertisement is over (which might be after a short delay, or after the user interacts with the advertisement, or after a video advertisement has completed, etc.) the entire display 1 is again allocated to an application 3 as shown in FIG. 2C. This approach does not restrict the display resources of the advertisement or the display resources of the application, but it does interrupt the application. In this approach the resource of time is shared between an application and an advertisement. Some studies show that interstitial advertisements are easily ignored. Some studies show that interstitial advertisements can be annoying to some users and can lead to users disliking the brand that is advertised and/or users uninstalling the application that hosted the interstitial advertisement. Another standard mode of resource sharing involves allocating actors or entities in an application to advertising. An example of allocating actors or entities in an application to advertising is in-app billboard advertising. Some racing applications depict billboards on the roadside. FIG. 3A shows the entire display 1 allocated to an application enabled for in-app advertisements 5 with a billboard entity 6 allocated to display advertisements. FIG. 3B shows the entire display 1 allocated to an application enabled for in-app advertisements 5 with a billboard entity 6 allocated to display advertisements with an advertisement 7 displayed on the billboard entity 6 as the racer approaches the billboard entity 6. As the racer approaches the billboard the in-app advertisement increases in size. FIG. 3C shows the entire display 1 allocated to the in-app application 5 after the racer has passed by the billboard. This approach restricts the display resources of the advertisement. Some studies show that in-app advertisements are easily ignored.

U.S. Pat. No. 10,019,737 B2 provides a solution to these problems that involves negating pixel values. Studies have shown that when colors are changed in advertiser's brand images the branding effect can reduce and/or become dissatisfying to viewers. The invention solves the resource sharing problems without negating colors. A solution presented in U.S. Pat. No. 10,019,737 B2 utilized shape information of actors, entities, or scenes. Shape information alone can lose depth information, i.e. when an actor or entity is behind/in front of another actor or entity. This invention solves the loss of depth information problem by detecting edges of an entire scene, thus preserving depth information.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

This invention provides a new and innovative solution to resource contention in advertising in electronic media. This invention provides methods to keep users eyes focused on advertisements, or other media, during gameplay and during use of other applications. This invention addresses the resource sharing problem by displaying both an application and an advertisement in the same region (the region can be the entire display resource or any part of the display resource or multiple display resources) concurrently. The solution employs mathematical manipulation of the colors of applications and/or advertisements. Advertisers are often very particular about the specific colors displayed in their advertisements, i.e. the color of their logo or the color of their font. Many applications can be used in their original colors just as well as they can be used in any color scheme that provides the contrast needed to distinguish actors and entities in the application and their movements and interactions. This invention allows the display of advertisements in their original colors except where application actors and entities and their interactions need to be discernable. For purposes of explanation 'actors and entities' is here intended to encompass all displayable aspects of typical applications. To provide discernable contrast this invention allows the display of edge information of actors and entities in the colors of a second image of an advertisement. In this manner both the advertisement (displayed in the original colors of a first image) and the edge information of actors and entities in the application (displayed in the original colors of a second image) are discernable. This invention solves the display resource sharing problem of banner advertisements and solves the time resource sharing problem of interstitial advertisements by displaying advertisements concurrently with applications. This invention can have embodiments that do not involve advertising, among which are: Displaying video concurrently with an application (i.e. playing a game while watching a TV show concurrently), displaying chart or graphical information concurrently with a video (i.e. displaying stock information concurrently with a movie), displaying a logo in the negative of an application, displaying an application in the negative of a logo, and displaying the action of one application while using another application (i.e. seeing the weather app while playing a game).

According to an embodiment, an image processing device and method of this invention includes a processor coupled to a memory and a display screen. The processor is configured to process a plurality of media formats (contexts) stored in the memory where each of the plurality of media formats is made up of a plurality of digital image layers that includes non-transparent pixels and/or transparent pixels. The processor sets the non-transparent pixels in some of the digital image layers of the plurality of media formats to a contrast state, for example, white and then sets pixels stored in an off-screen data buffer of the memory to pixels corresponding to a predetermined color scheme, for example, white. The processor then applies various image functions to some of the plurality of media formats drawn successively to the off-screen data buffer so as to allow the plurality of overlapping media formats to be displayed on the display screen as see through or transparent or translucent, etc.

In another embodiment of this invention, the processor is further configured to filter an application to yield a contrast state showing edge vs non-edge information by application of combinations of blur, grayscale, edge detection, and threshold functions.

In another embodiment of this invention, the processor is further configured to simultaneously draw the off screen buffer and another media format to the display screen by using the same pixels and by displaying the true color information of selected layers of the another media format and overlapping the edge information of the pixels in the off screen buffer as the image function applied to the true colors of the selected layers of the another media format.

In yet another embodiment of this invention, the image function being a blur, grayscale, edge detect and/or threshold to two or more states, i.e. black and white, (BGET) function that blends the pixels in the digital image layer with the non-transparent pixels in an off-screen data buffer to generate new pixel values in a second off-screen data buffer. The new pixel values are generated by applying the BGET function to pixels in the digital image layer corresponding to non-transparent pixels in and offscreen data buffer while drawing the filtered pixels to a second off-screen buffer. The pixels in a second offscreen data buffer are then blended with the pixels in a first offscreen data buffer using a select function to generate the pixel values in a third offscreen data buffer. The new pixel values in a third offscreen data buffer are generated by selecting the color of the pixel in a first offscreen data buffer when the corresponding pixel in a second offscreen data buffer is black, and selecting a separate, i.e., white, color when the corresponding pixel in a second offscreen data buffer is white (or vice versa). The pixels in a third offscreen data buffer are then blended with a fourth offscreen data buffer to generate new pixel valued in a fifth offscreen data buffer using a select filter. The new pixel values in the fifth offscreen data buffer are generated by selecting the color of the pixel in a third offscreen data buffer when the color does not equal the value of the separately selected color, and selecting the color of the corresponding pixel in a fourth offscreen data buffer when the color does equal the value of the separately selected color (or vice-versa). The resulting pixel values of the digital image layer are then blended with the non-transparent pixels in a fifth offscreen data buffer using the painters algorithm. The new pixel values are set to the value in the digital image layer except where the corresponding pixels in the offscreen data buffer are non-transparent, in that case the value of the pixel is set to the value of the pixel in a fifth offscreen data buffer.

In yet another embodiment of this invention, the image function being a blur, grayscale, edge detect to two or more states, i.e. black and white, (BGET) function that blends the pixels in the digital image layer with the non-transparent pixels in an off-screen data buffer to generate new pixel values in a second off-screen data buffer. The new pixel values are generated by applying the BGET function to pixels in the digital image layer corresponding to non-transparent pixels in and offscreen data buffer while drawing the filtered pixels to a second off-screen buffer. The pixels in a second offscreen data buffer are then blended with the pixels in a first offscreen data buffer using a select function to generate the pixel values in a third offscreen data buffer. The new pixel values in a third offscreen data buffer are generated by selecting the color of the pixel in a first offscreen data buffer when the corresponding pixel in a second offscreen data buffer is white and black otherwise. A sixth offscreen data buffer is generated by negating the black and white pixels in the second offscreen data buffer. The pixels in a sixth offscreen data buffer are then blended with a fourth offscreen data buffer to generate new pixel valued in a fifth offscreen data buffer using a select filter. The new pixel values in the fifth offscreen data buffer are generated by selecting the color of the pixel in a fourth offscreen data buffer when the corresponding pixel in a sixth offscreen data buffer is white and black otherwise. A seventh offscreen data buffer is generated by blending the pixel values in a third and fifth offscreen data buffers. The new pixel values in the seventh offscreen data buffer are generated by selecting the lightest corresponding pixel values between the third and fifth offscreen data buffers. The resulting pixel values of the digital image layer are then blended with the non-transparent pixels in a seventh offscreen data buffer using the painters algorithm. The new pixel values are set to the value in the digital image layer except where the corresponding pixels in the offscreen data buffer are non-transparent, in that case the value of the pixel is set to the value of the pixel in a fifth offscreen data buffer.

In another embodiment the image filter being a blending function of more than two layers of an advertisement.

In another embodiment the media layers being arranged side by side instead of one on top of another. The side by side images can be displayed one on top of the other to result in layers that are aligned. The media could be static or dynamic, i.e. still or motion.

The above and/or other aspects, features and/or advantages of various embodiments of this invention will be further appreciated in view of the following description in conjunction with the accompanying figures. Various embodiments of this invention can include and/or exclude different aspects, features and/or advantages where applicable. In addition, various embodiments of this invention can combine one or more aspects or features of other embodiments where applicable. The descriptions of aspects, features and/or advantages of particular embodiments should not be construed as limiting other embodiments or claims.

DETAILED DESCRIPTION OF THE INVENTION

Figure 1:
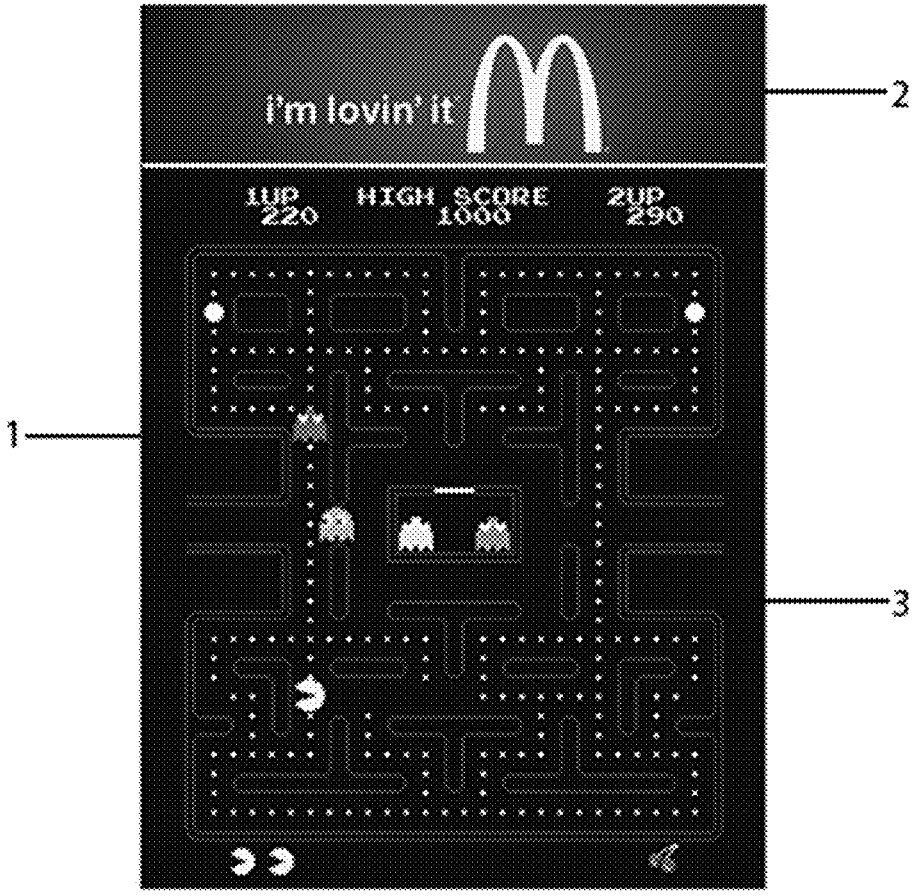
FIG. 1 illustrates a banner advertisement.
Figure 2A:
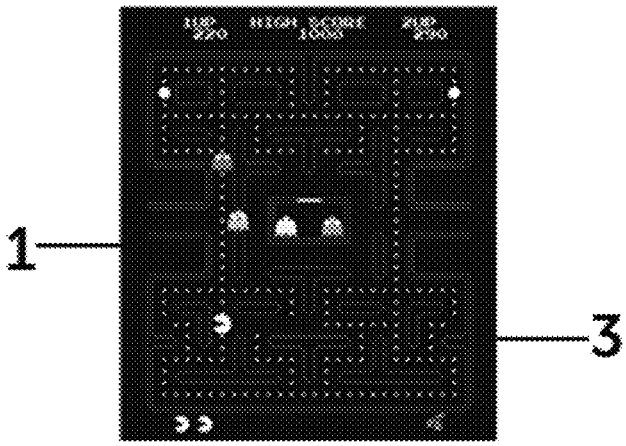
FIG. 2A illustrates an application before the display of an interstitial advertisement.
Figure 2B:
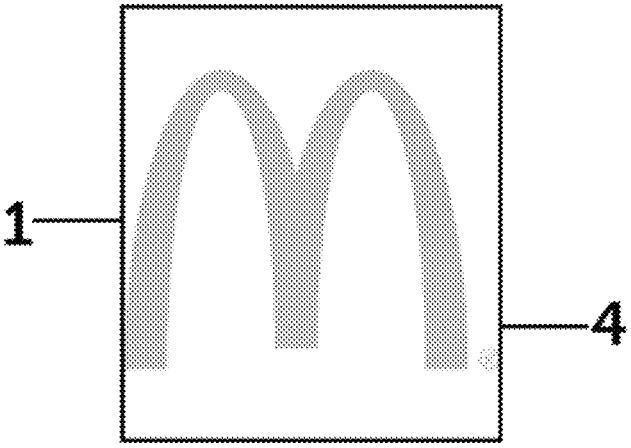
FIG. 2B illustrates the display of an interstitial advertisement.
Figure 2C:
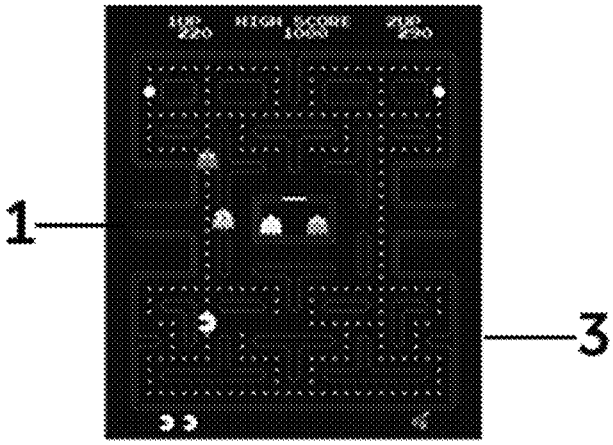
FIG. 2C illustrates an application after the display of an interstitial advertisement.
Figure 3A:
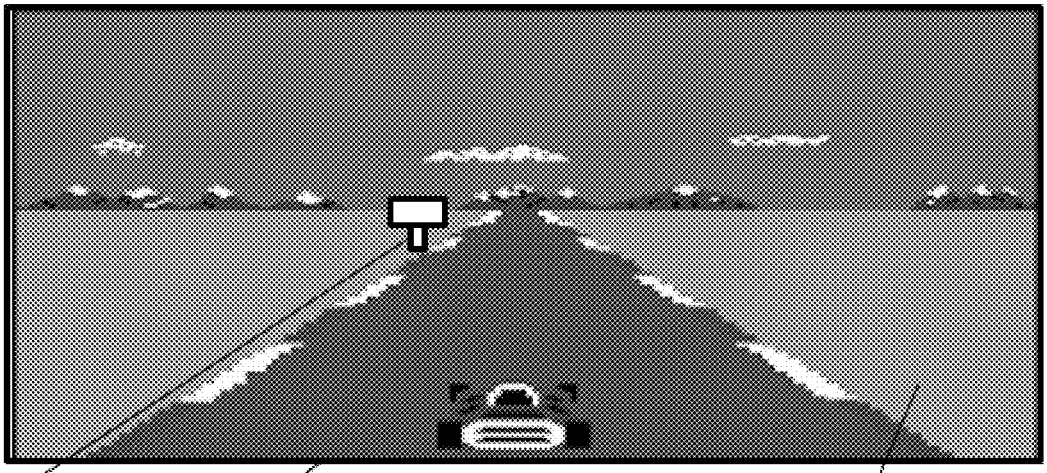
FIG. 3A illustrates an application ready to display an in-application advertisement.
Figure 3B:
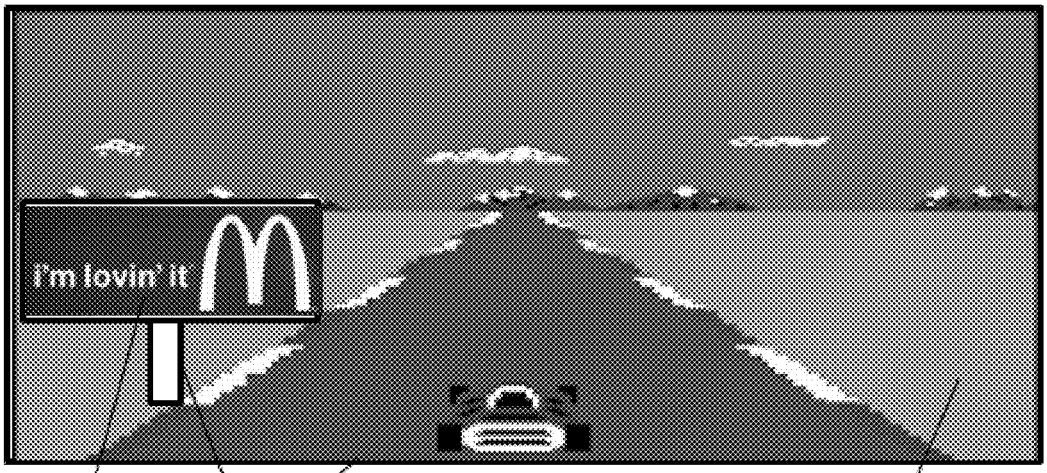
FIG. 3B illustrates an application displaying an in-application advertisement.
Figure 3C:
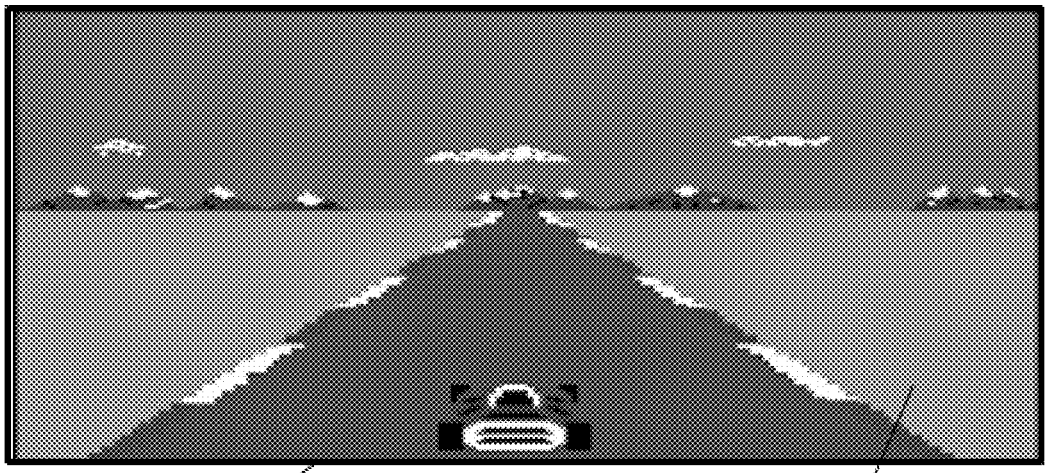
FIG. 3C illustrates an application after displaying an in-application advertisement.

The subject invention is now described with reference to the drawings, wherein like reference numerals are used to refer to like elements throughout. In the following description, for purposes of explanation, numerous specific details are set forth in order to provide a thorough understanding of the subject invention. It may be evident, however, that the subject invention can be practiced without these specific details. In other instances, well-known structures and devices are shown in block diagram form in order to facilitate describing the subject invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

Figure 4A:
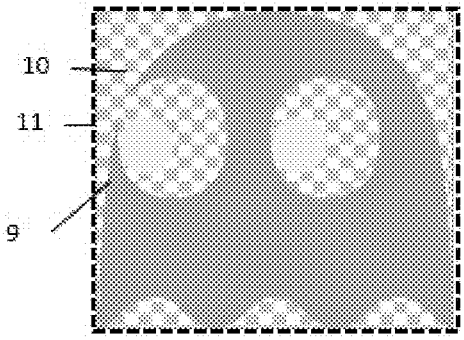
FIG. 4A illustrates a sample actor from an application.
Figure 4B:
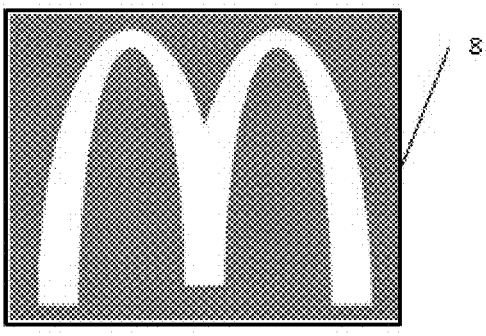
FIG. 4B illustrates a sample layer of an advertisement.
Figure 4C:
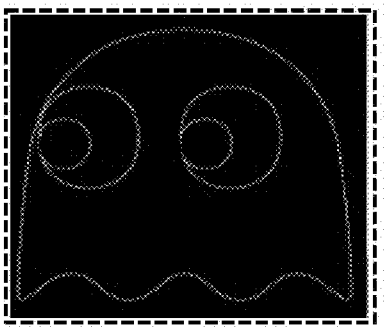
FIG. 4C illustrates edge information of a sample actor from an application.
Figure 4D:
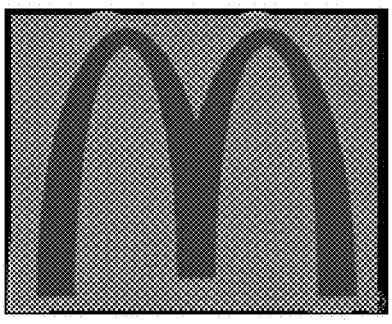
FIG. 4D illustrates a sample second layer of an advertisement.
Figure 4E:
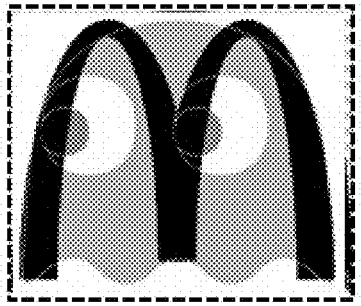
FIG. 4E illustrates a sample actor from an application displayed with edge information in the color of a sample second layer of an advertisement.
Figure 4F:
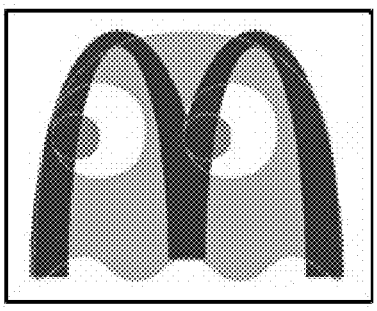
FIG. 4F illustrates two layers of a sample advertisement displayed over a sample actor from an application where the edge information is displayed in the pixel colors of a sample layer 2.

In an exemplary embodiment, this aforementioned problem of resource sharing and taking turns may be solved by displaying two contexts, e.g. application (context1) and a multi-layer advertisement (context2), at the same time using the same pixels by displaying the true color information of context2 and overlapping the edge information of context1 as a function to select which layer of context2 to display. In a simple embodiment a function could be a composite blur, grayscale, edge detection, threshold (BGET) image function. A BGET image function would display the edge information of context1 as one color, i.e. white, where edges are detected and would display all other non-transparent pixels as another color, i.e. black. A select function would display the colors of a layer of context2 where the BGET function displays black, and would display the colors of a second layer of context2 where the BGET function displays white. The BGET filter can first blur the image to reduce noise. In an embodiment a standard gaussian blur with a variable standard deviation could be applied to blur the image. A different standard deviation could be selected to provide an optimal noise reduction for each scene of a particular application. In an embodiment a blur/noise reduction filter could be one of various industry standard filters. A BGET filter could then apply a standard grayscale filter. A BGET filter could then apply an edge detection filter. In an embodiment an edge detection filter could be a 3×3 convolve matrix of the form ((−1, −1, −1), (−1, 8, −1), (−1, −1, −1)). In an embodiment an edge detection filter could be a Sobel filter. In an embodiment an edge detection filter could be one of various industry edge detection filters. A standard edge detection image function could display the edge information of context1 as lighter grayscale values and all other information as darker grayscale values. A BGET function could then edge detect the grayscale values to set all pixel values to one of two colors, i.e. white and black. One color represents all edge information detected, and one color represents all non-edge information. In an embodiment an edge detection filter could be one of various industry edge detection filters. FIG. 4A shows a sample character 9 from a full color PacMan application as context1. Typical actors and entities in applications are defined inside rectangular bounding boxes. In order to have actors and entities that are not displayed rectangular when they are rendered into a scene the pixels in the rectangular region that are not part of the actor or entity can be defined as 'transparent' pixels. When the rectangle bounding the actor or entity is drawn the software ignores transparent pixels and draws only the non-transparent pixels. The gray checkboard pattern 10 signifies transparent pixels and the dotted line 11 signifies the rectangular bounding box. The various shades of gray represent different colors used by the sample application. FIG. 4B shows a layer of a sample advertisement 8 as a layer of context2. Typical advertisements are full color but for purposes of explanation black and white and grayscale are used to represent the true colors of layers of context2. FIG. 4C shows the edge information of FIG. 4A after applying a BGET function. White represents the essential edge information of a background or actor or entity or other object or scene in an application. FIG. 4D shows a second layer of an image of the sample advertisement of FIG. 4B. For purpose of illustration an advertisement may have a standard pair of colors, i.e. yellow and red, that are used in branding. FIG. 4D might be yellow arches and FIG. 4B might be red arches. Each layer in a multi-layer context2 could be designed and colored and approved by an advertiser. FIG. 4E shows FIG. 4A displayed in the edge information pixels of FIG. 4C colored using the corresponding pixel values of a second layer of the sample advertisement shown in FIG. 4B. FIG. 4F shows the sample actor of FIG. 4A with the edge information of FIG. 4C displayed using the pixel values of FIG. 4B and the non-edge pixels displayed using the corresponding pixel values of FIG. 4D. In FIG. 4F every pixel of the sample advertisement is displayed as either the original color value of layer 1 of the advertisement or the original color value of layer 2 of the advertisement. Where the edge information of FIG. 4C is not white the original color value of layer 1 of the advertisement is displayed. Where the edge information of FIG. 4C is white the original color value of layer 2 of the advertisement is displayed. Where the pixels of FIG. 4D are transparent the original color value of FIG. 4A are displayed. Where the pixels of FIG. 4A are transparent the original color value of FIG. 4D are displayed.

Conceptually a BGET image function provides two states—the positive state, i.e. black, shows layer 1 of context2 in original RGB colors, and the negative state, i.e. white, shows layer 2 of context2 in original RGB colors. This two state functionality provides contrast to discern edge information of context1. Several other standard image functions can be applied to provide two states, e.g. sepia, grayscale, charcoal, etc.

Discernible contrast between corresponding pixels in layers of an advertisement is required to visually discern edge information of an application. Standard color distance calculations, i.e. CIE76, can be applied to show where contrast is low or high. Low contrast will not display edge information clearly. Layers 1 and layers 2 could be displayed using a checkerboard or striped or concentric circle black and white selecting filter to visually discern contrast in the layers.

Various embodiments of this invention can have different sources for context1 and context2. One context could be an application and the other context could be an advertisement, or vice versa. One context could be video or animation and the other context could be displayed as an overlay which displays the video through a function. Both contexts could be applications. These are listed as examples of different sources for context1 and context2 and are not intended to be an exhaustive list.

Various embodiments of this invention can use color schemes other than RGB, e.g. CMYK. This same image processing device and method can be applied to different color schemes.

Various embodiments of this invention can utilize images defined as raster or vector. For purposes of explanation raster images are assumed. This same image processing device and method can be applied to vector images.

Many Integrated Development Environments (IDEs) provide functionality to computer programmers for software development. Many IDEs include image editing functionalities. Typical scene rendering in an IDE includes capabilities for drawing scenes one layer at a time in which successively drawn layers overwrite previously drawn layers (painter's algorithm) and capabilities for applying image functions when drawing. Typical image functions include grayscale, sepia, blur, brightness, contrast, invert (negative), saturate, opacity, threshold, edge detection, and blending. IDEs could be expanded to provide the new functionality described in this invention.

Many advertising networks provide Software Development Kits (SDKs) that developers can include in their applications to allow the displaying of advertisements. Typical SDKs allow display of banner, interstitial, and in-app advertisements. SDKs could be expanded to provide the new functionality described in this invention.

Applications often allow/require user interaction in the form of clicking, dragging, squeezing, swiping, etc. Advertisements often allow/require user interaction in the form of clicking through, making a selection, etc. The challenge of allowing/requiring user interaction for both application and advertisement concurrently can be overcome in various ways, e.g. by allocating a hot-spot on the display reserved for advertisement click through. Other methods might select a particular actor or entity as the click through agent for the advertisement. Another method might allow the advertiser to provide an additional actor or entity, e.g. an icon or logo, which is displayed. This additional actor or entity could be displayed in a static location or be made to move to locations on the display away from current user interaction. Another method might display a standard clickable banner ad and also display a context 2 branding ad in an application. These are listed as examples of allowing user interaction when more than one context is displayed concurrently and are not intended to be an exhaustive list.

Figure 5A:
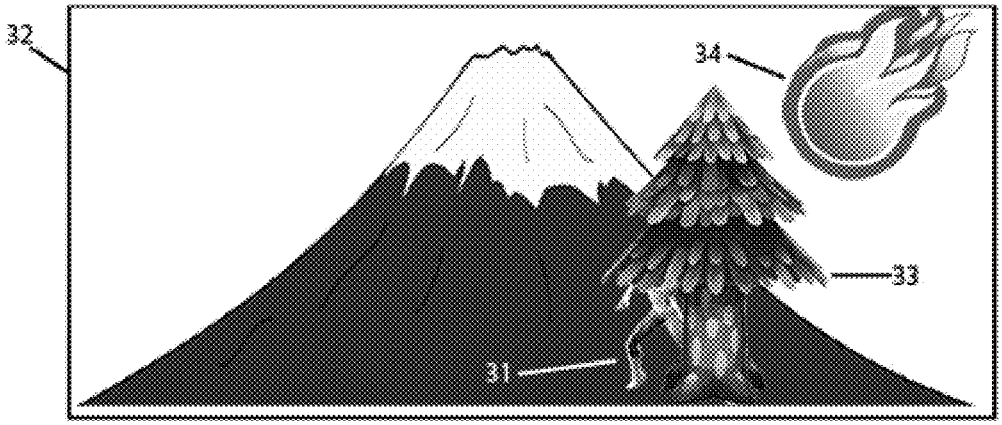
FIG. 5A illustrates an application interaction with actors on the right side of the scene and separated some distance.
Figure 5B:
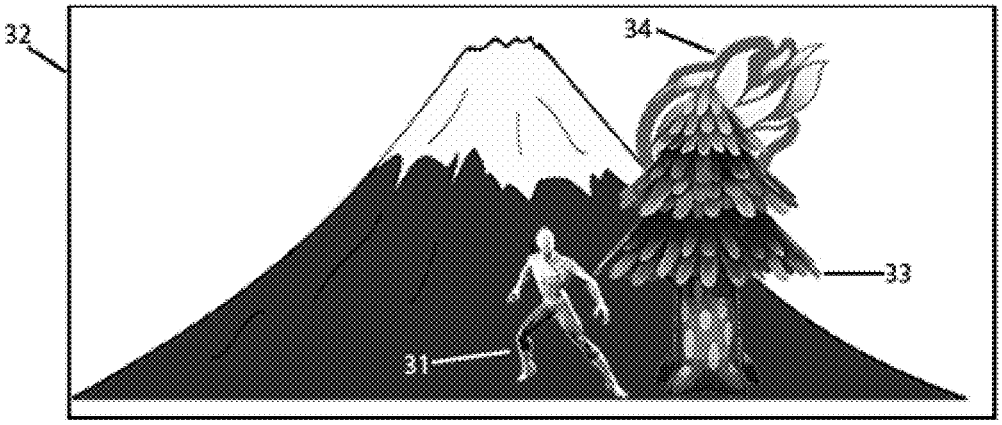
FIG. 5B illustrates an application interaction with actors closer to the center of the scene and separated a smaller distance.
Figure 5C:
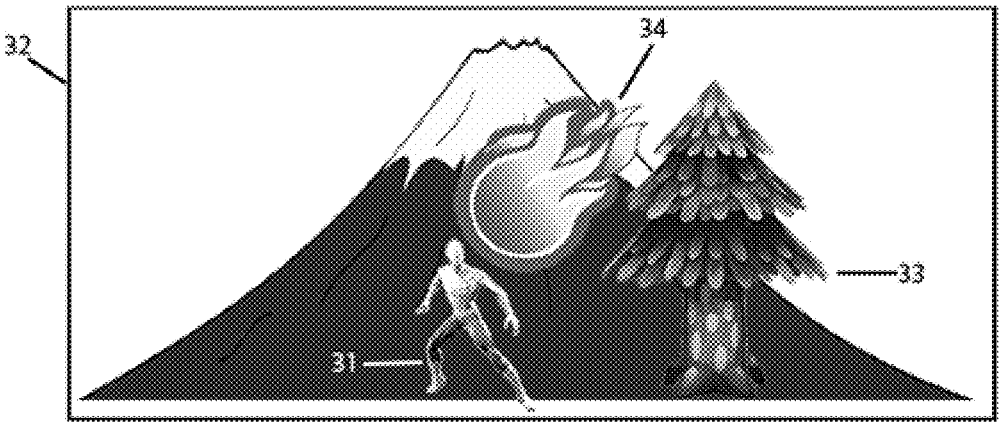
FIG. 5C illustrates an application interaction with actors to the left of the center of the scene and almost touching.

FIG. 5A illustrates an application interaction with man actor 31 and comet actor 34 on the right side of the scene and separated by some distance. The man actor 31 appears to be behind the tree entity 33 and in front of the background 32. FIG. 5B illustrates an application interaction with man actor 31 and comet actor 34 closer to the center of the scene and separated by a smaller distance. The man actor 31 appears to be in front of the background 32 and the comet actor 34 appears to be behind the tree entity 33. FIG. 5C illustrates an application interaction with man actor 31 and comet actor 34 to the left of the center of the scene and almost touching. The man actor 31 and comet actor 34 appear to be in front of the background 32. The background 32 is a background image that occupies the entire display region. Typically, there is no interaction between the background and any actors or entities. Background is often filler, or branding, or intended to add interesting imagery. Typically, backgrounds are displayed as either stationary or moving. Stationary backgrounds are typically the same size as the display region. Moving backgrounds are typically larger than the display region so that successive frames can display different portions of the background to give the appearance of motion. For purposes of explanation a stationary background is used but this invention applies to moving backgrounds as well.

Figure 6A:
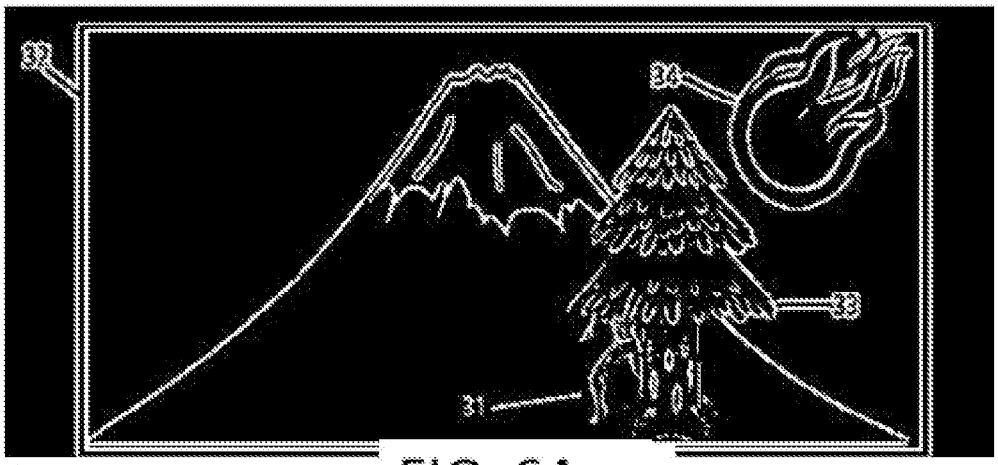
FIG. 6A illustrates edge information of an application interaction with actors on the right side of the scene and separated some distance.
Figure 6B:
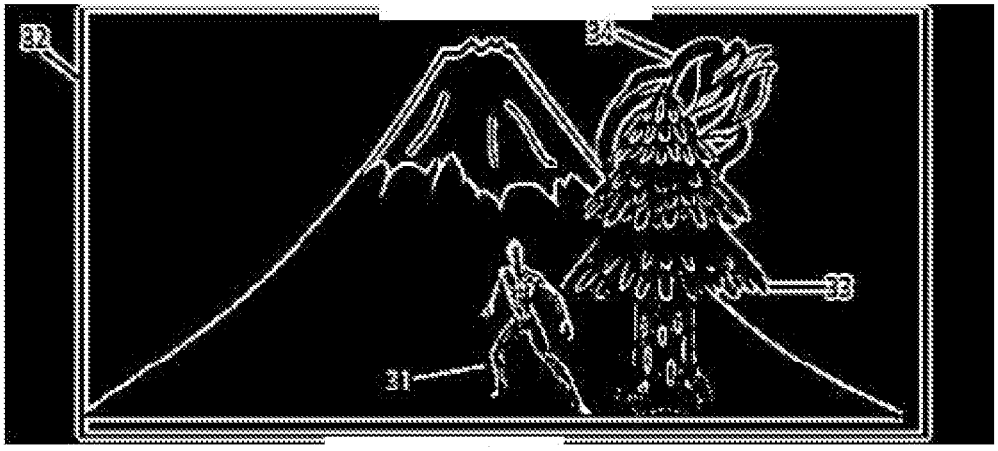
FIG. 6B illustrates edge information of an application interaction with actors closer to the center of the scene and separated a smaller distance.
Figure 6C:
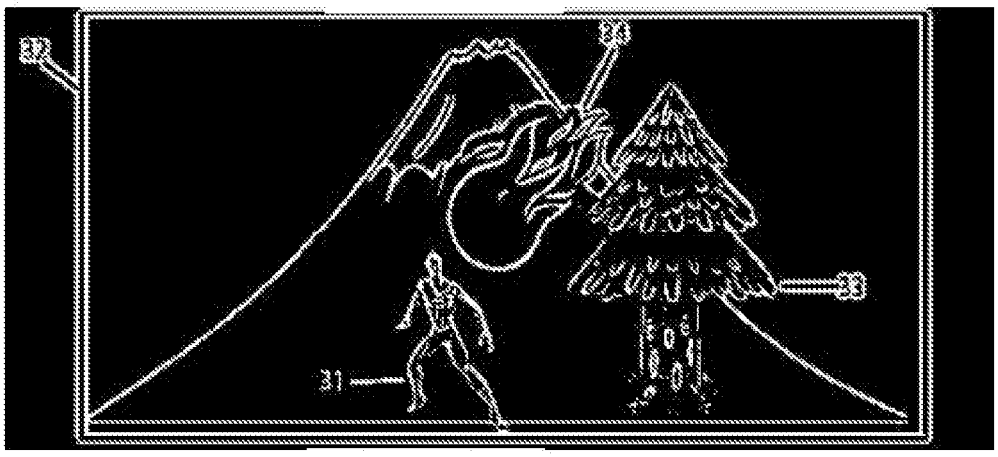
FIG. 6C illustrates edge information of an application interaction with actors to the left of the center of the scene and almost touching.

FIG. 6A shows FIG. 5A edge information. FIG. 6B shows FIG. 5B edge information. FIG. 6C shows FIG. 5C edge information. FIG. 6A illustrates an application interaction with man actor edge information 31 and comet actor edge information 34 on the right side of the scene and separated by some distance. The man actor 31 appears to be behind the tree entity edge information 33. FIG. 6B illustrates an application interaction with man actor 31 and comet actor 34 closer to the center of the scene and separated a by smaller distance. The comet actor 34 appears to be behind the tree entity 33. FIG. 6C illustrates an application interaction with man actor 31 and comet actor 34 to the left of the center of the scene and almost touching. Note that the shapes/edges are evident in the actors and entities. Note that prototypical interaction is still apparent.

FIG. 5A, FIG. 5B, FIG. 5C and FIG. 6A, FIG. 6B, FIG. 6C demonstrate that some applications can exhibit actor and entity interaction with color or with edge information, i.e. only edge information is required.

Figure 6D:
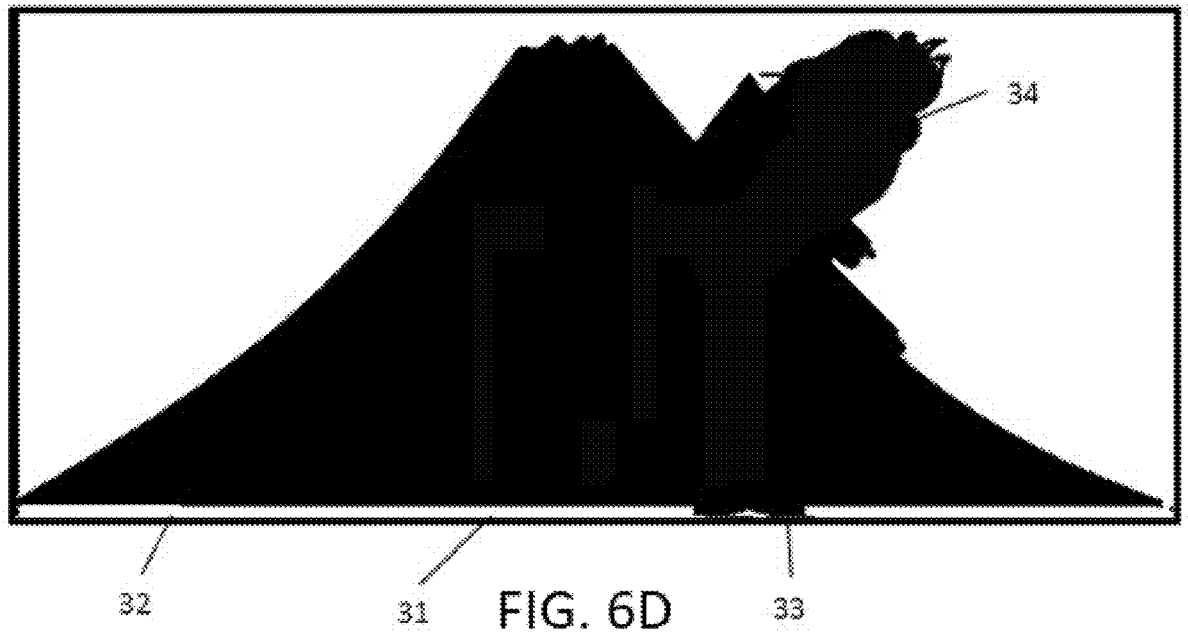
FIG. 6D illustrates shape information of an application.
Figure 6E:
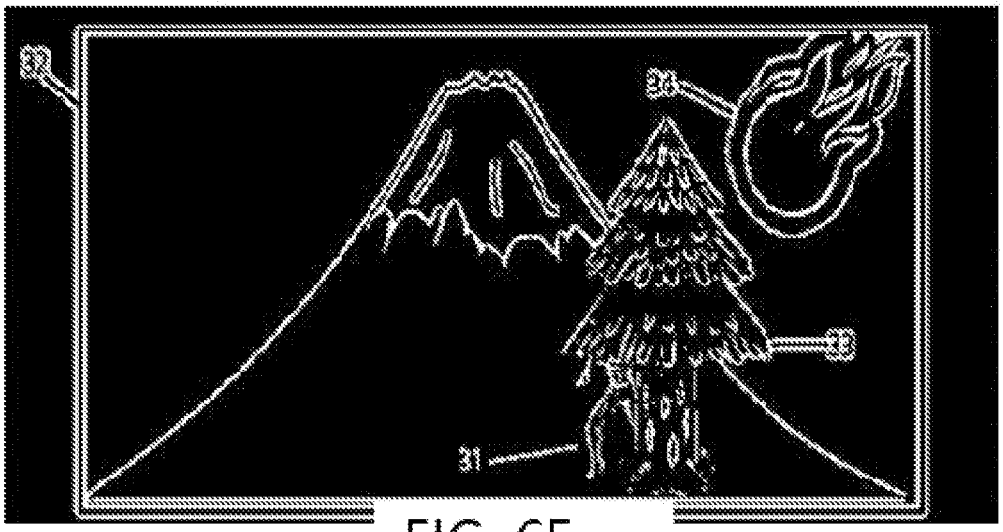
FIG. 6E illustrates edge information of an application.

FIG. 6D shows the shape information that may result in applying a solution using methods of U.S. Pat. No. 10,019,737 B2. If only two states are identified, actor/entity vs non-actor/non-entity then the shapes of the comet and tree are conceptually combined to form a new single shape. This combining loses the depth information that shows which actor/entity is behind which actor/entity and which is in front. FIG. 6E shows the edge information that may result in applying methods of this invention. Note that background information can be preserved. Note that depth information can be preserved.

Figure 7A:
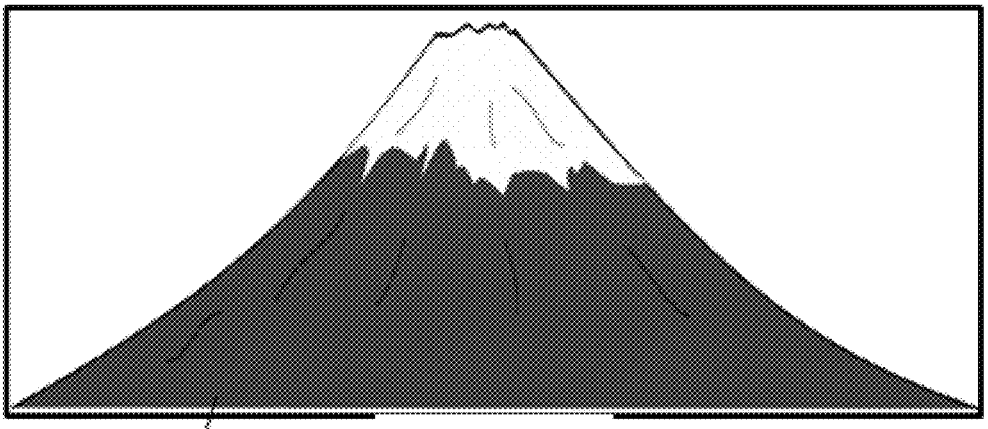
FIG. 7A illustrates a painter's algorithm with a background layer drawn first.
Figure 7B:
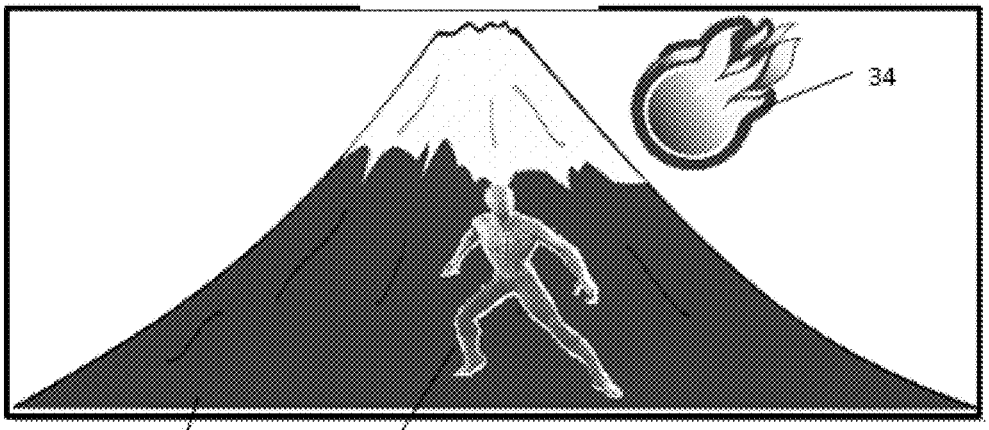
FIG. 7B illustrates a painter's algorithm with a second layer drawn over the background layer.
Figure 7C:
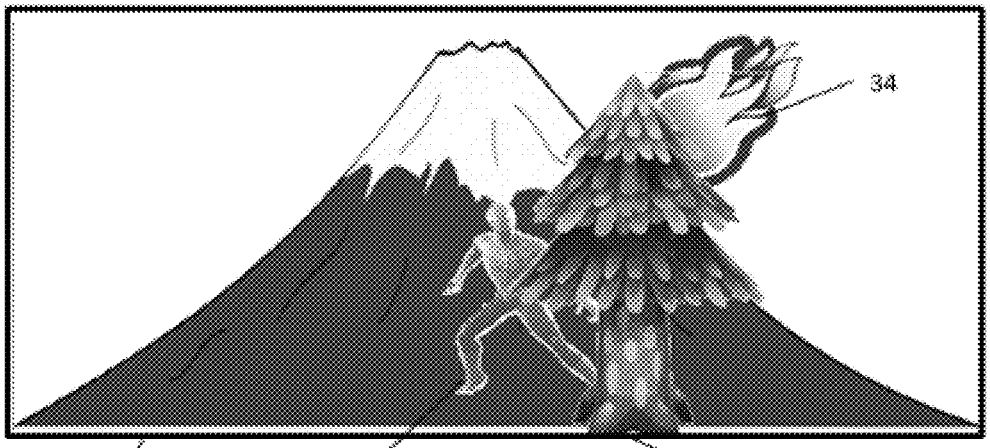
FIG. 7C illustrates a painter's algorithm with a third layer drawn over the second and background layers.

Each scene in many typical applications is drawn using a painter's algorithm. Scenes are usually defined in layers that are different distances from the viewer. FIG. 7A shows a typical background 32 scene rendered using the painter's algorithm. The background layer (layer1) is the furthest from the viewer. FIG. 7A shows the background drawn first. The next furthest layer (layer2) from the viewer (which is the closest layer to the background) is then drawn on top of the background. The man actor 31 and the comet actor 34 are defined to be in layer2 drawn in FIG. 7B. FIG. 7B shows that pixels drawn in layer2 obscure some of the pixels drawn in layer1, i.e. the pixels in the background 32 that are 'behind' the man actor 31 are not displayed, they were 'painted' over. FIG. 7C shows that the tree entity 33, defined to be in layer3, is drawn last. The pixels in tree entity 33 obscure some of the pixels in the man actor 31 and comet actor 34 and also obscure some of the pixels in the background 32. The painter's algorithm draws scenes to display some actors and entities as 'behind' other actors and entities and 'in front of' other actors and entities and backgrounds.

Figures 8A, 8B:
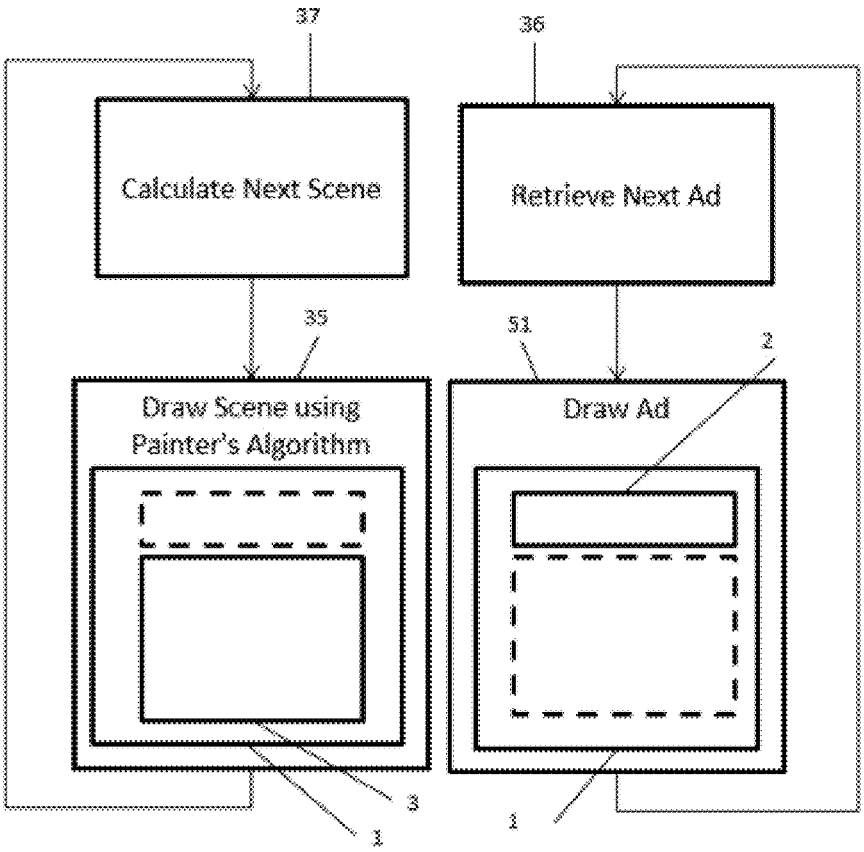
FIG. 8A illustrates a flow chart of an application thread drawing to a lower part of the display.
FIG. 8B illustrates a flow chart of an advertisement thread drawing to an upper part of the display.

When advertising is incorporated into an application there are typically multiple threads of execution running concurrently. One thread can be for the application and one thread can be for the advertisement. FIG. 8A and FIG. 8B show two threads running concurrently where the advertisement is a banner advertisement. Similar logic is employed for other types of advertisements. FIG. 8A shows the application thread. The application calculates the next scene to be drawn 37, then draws that scene using the painter's algorithm 35. In this example the application 3 is drawn in a lower portion of the display 1. Concurrently the advertisement thread retrieves the next advertisement 36 then draws the advertisement 51 as shown in FIG. 8B. In this example the advertisement 2 is drawn in a top portion of the display 1. Note that the application thread draws only in the display region allocated to the application and the advertisement thread draws only in the display region allocated to the advertisement.

Figure 9A:
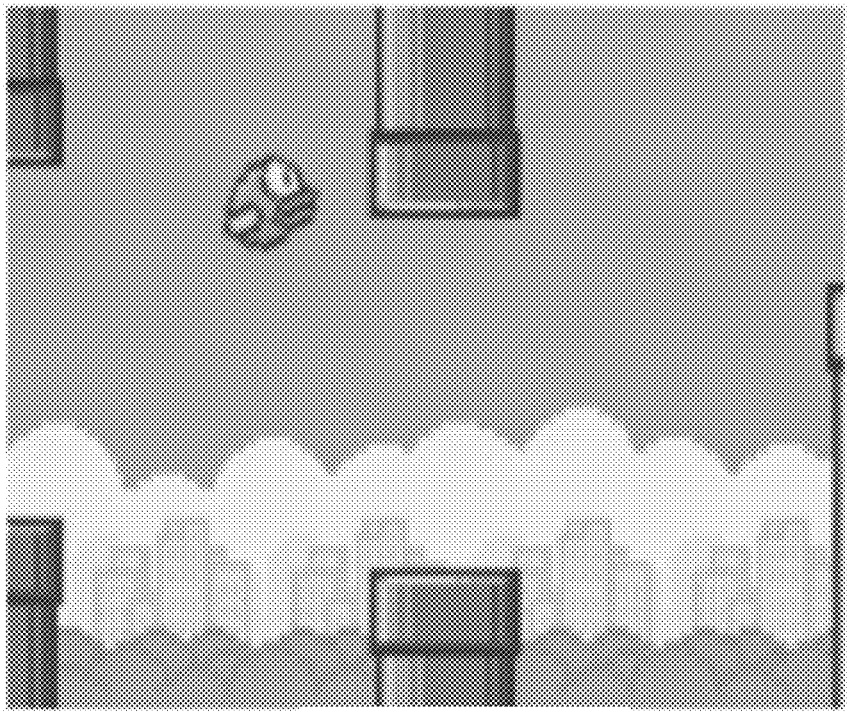
FIG. 9A illustrates a preprocessing step setting the standard deviation low on a standard blur function.
Figure 9B:
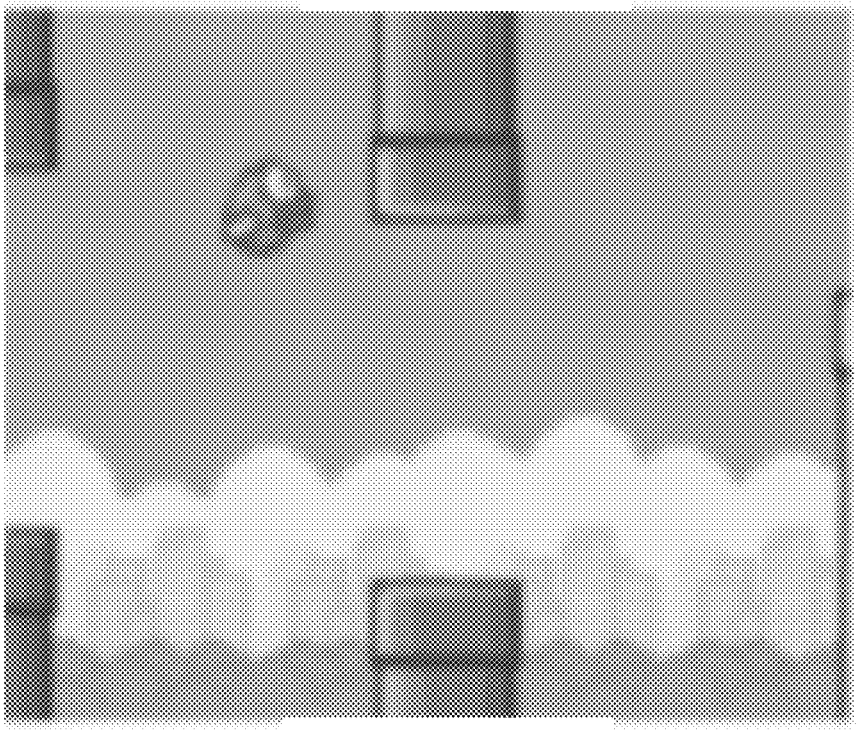
FIG. 9B illustrates a preprocessing step setting the standard deviation high on a standard blur function.
Figure 9C:
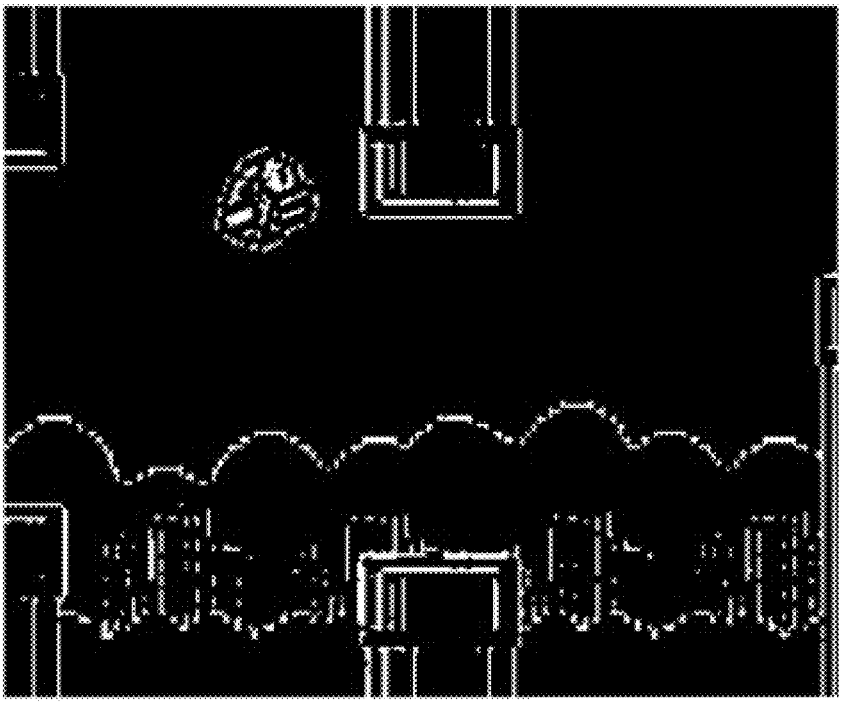
FIG. 9C illustrates a preprocessing step setting the threshold low on a standard threshold function.
Figure 9D:
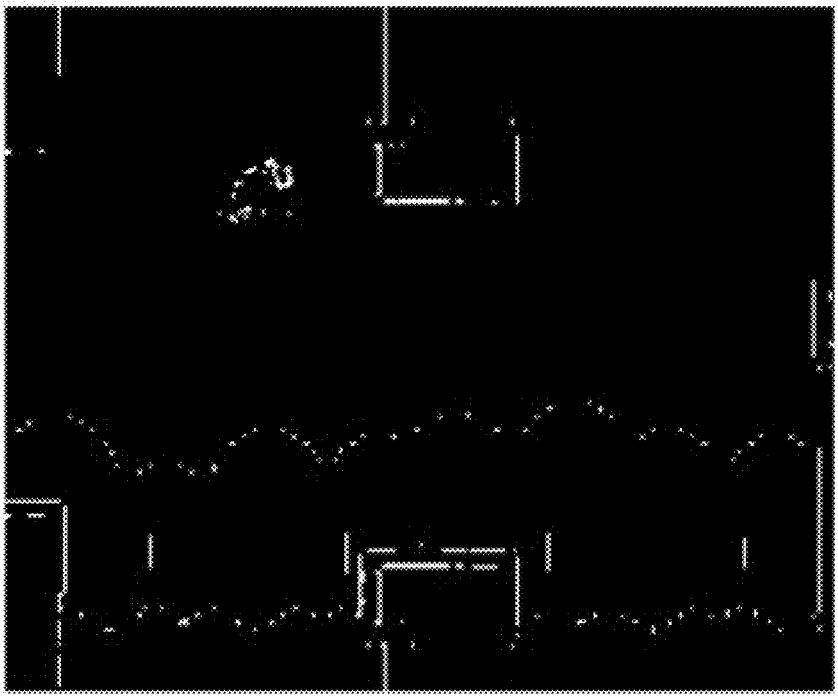
FIG. 9D illustrates a preprocessing step setting the threshold low on a standard threshold function.

In an exemplary embodiment this invention adds a preprocessing step to the typical application thread. This preprocessing step can include a manual or automatic setting of the standard deviation of a gaussian blur filter to optimize noise reduction for improved edge detection. The preprocessing step can include a manual or automatic setting of an edge detection kernel to optimize edge detection. FIG. 9A shows a preprocessing step where the standard deviation of a gaussian blur function has been set low. FIG. 9B shows a preprocessing step where the standard deviation of a gaussian blur function has been set high. FIG. 9C shows a preprocessing step where the threshold value of a threshold function has been set low. FIG. 9D shows a preprocessing step where the threshold value of a threshold function has been set high. These settings can be automatically or manually set to best select edges for a particular application or scene in an application.

Figure 10:
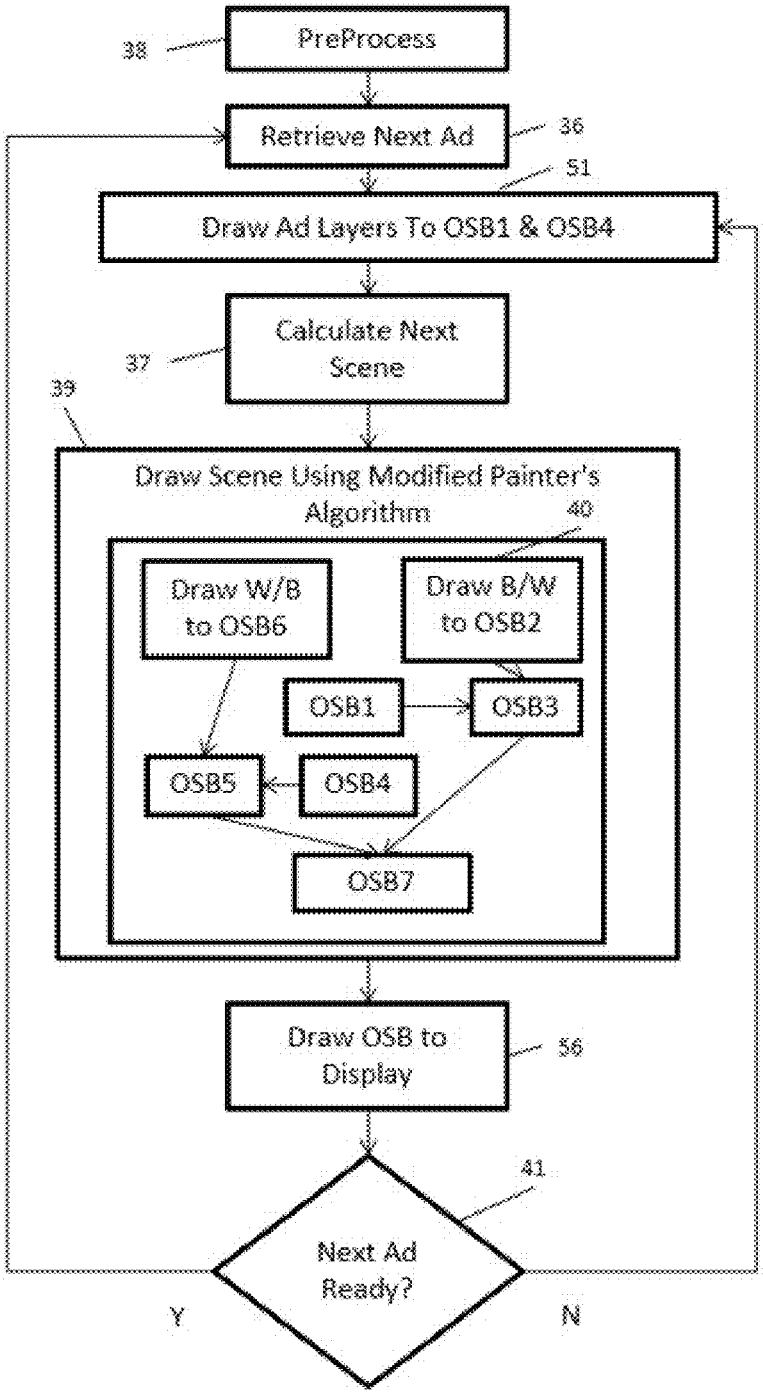
FIG. 10 illustrates a modified application thread with advertisement thread.

FIG. 10 shows the modified application thread from FIG. 8A combined with the advertisement thread of FIG. 8B to display both application (context1) and advertisement (context2) at the same time using the same pixels by displaying the true color information of context2 and overlapping the edge information of context1 as a selecting function applied to the true colors of the layers of context2. First the preprocessing step 38 (FIG. 9) sets the threshold and standard deviation of the BGET filter. The next step is to retrieve the next advertisement (context2) 36. The layers of the current advertisement are drawn to OSB1 and OSB4. The advertisement may be drawn fullscreen or to any portion of the display. The layers of the advertisement may contain transparent pixels. There may be multiple advertisements drawn. The next step is for the application to calculate the next scene 37. The next scene is drawn to the display 56, and drawn to OSB2 using the BGET filter. OSB3 is drawn using OSB2 as a select filter against OSB1. Where the pixels in OSB1 are transparent the pixels in OSB3 are set to transparent. Where the pixels in OSB1 are not transparent and the pixels in OSB2 are white the pixels in OSB1 are drawn, otherwise black is drawn. OSB6 is drawn as the negative of OSB2. OSB5 is drawn using OSB6 as a select filter against OSB4. Where the pixels in OSB4 are transparent the pixels in OSB5 are set to transparent. Where the pixels in OSB4 are not transparent and the pixels in OSB6 are white the pixels in OSB4 are drawn, otherwise black is drawn. OSB7 is drawn using a select function that selects the lighter of the pixels in OSB5 and OSB 3. OSB7 is then drawn to the display using the painters algorithm. The next step 41 checks to see if there is another advertisement to display. If there is another advertisement to display the algorithm goes to step 36 retrieve next advertisement. If there is not another advertisement to display the algorithm goes to step 51 draw advertisement to display.

Figure 11A:
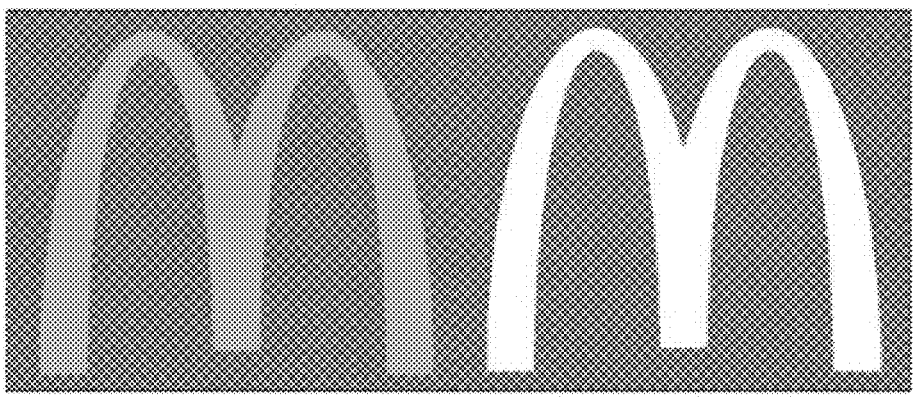
FIG. 11A illustrates two layers of a sample advertisement.
Figure 11B:
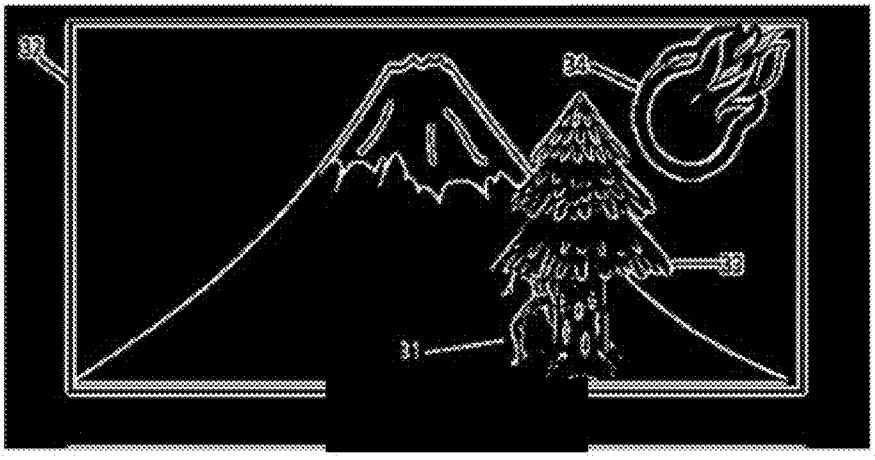
FIG. 11B illustrates an offscreen buffer of FIG. 6A.
Figure 11C:
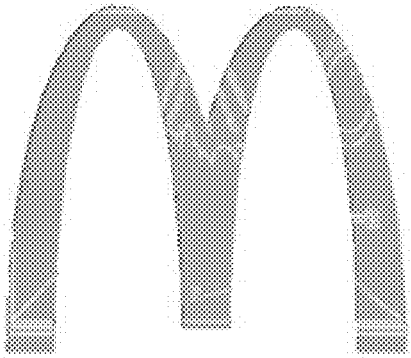
FIG. 11C illustrates an offscreen buffer drawn over a layer of a sample advertisement with a selective blending function.

FIG. 11A shows a sample advertisement layer 1 and layer 2. FIG. 11B shows the edge information in OSB2 from FIG. 6A. FIG. 11C shows the result of drawing the OSB2 from FIG. 11B to the sample advertisement layers of FIG. 11A using the selecting function. Note that where the OSB2 is black the original colors of the advertisement layer 1 are displayed and where the OSB2 is white the original colors of the advertisement layer 2 are displayed.

Figure 12A:
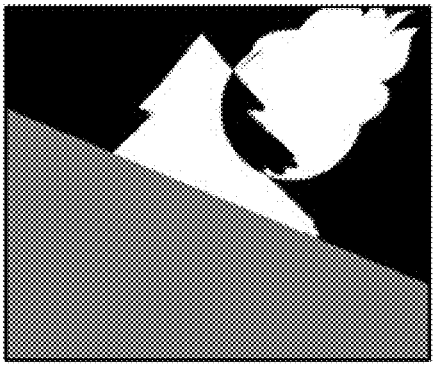
FIG. 12A illustrates a first layer of an advertisement
Figure 12B:
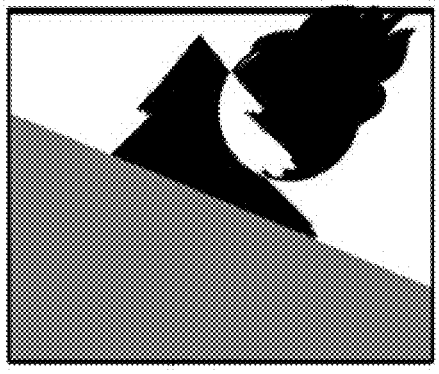
FIG. 12B illustrated a second layer of an advertisement with a region that is close in color to the first layer.
Figure 12C:
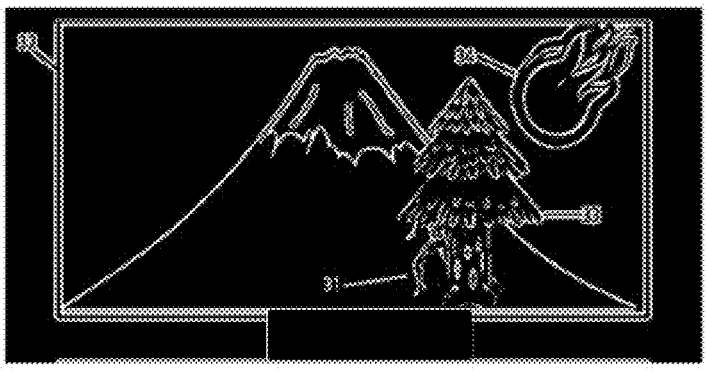
FIG. 12C illustrates the results of applying a CBET filter to a scene in an application

When the layers in context2 have corresponding regions that are "close" in color the contrast can be too low to discern edge information of actors and entities. FIG. 12A shows a representation of a first layer of an image advertisement. FIG. 12B shows a representation of a second layer of an image advertisement. Note that the bottom left area of the two images are "close" in color. FIG. 12C represents the results of applying a CBET filter to a scene in an application.

Figure 13:
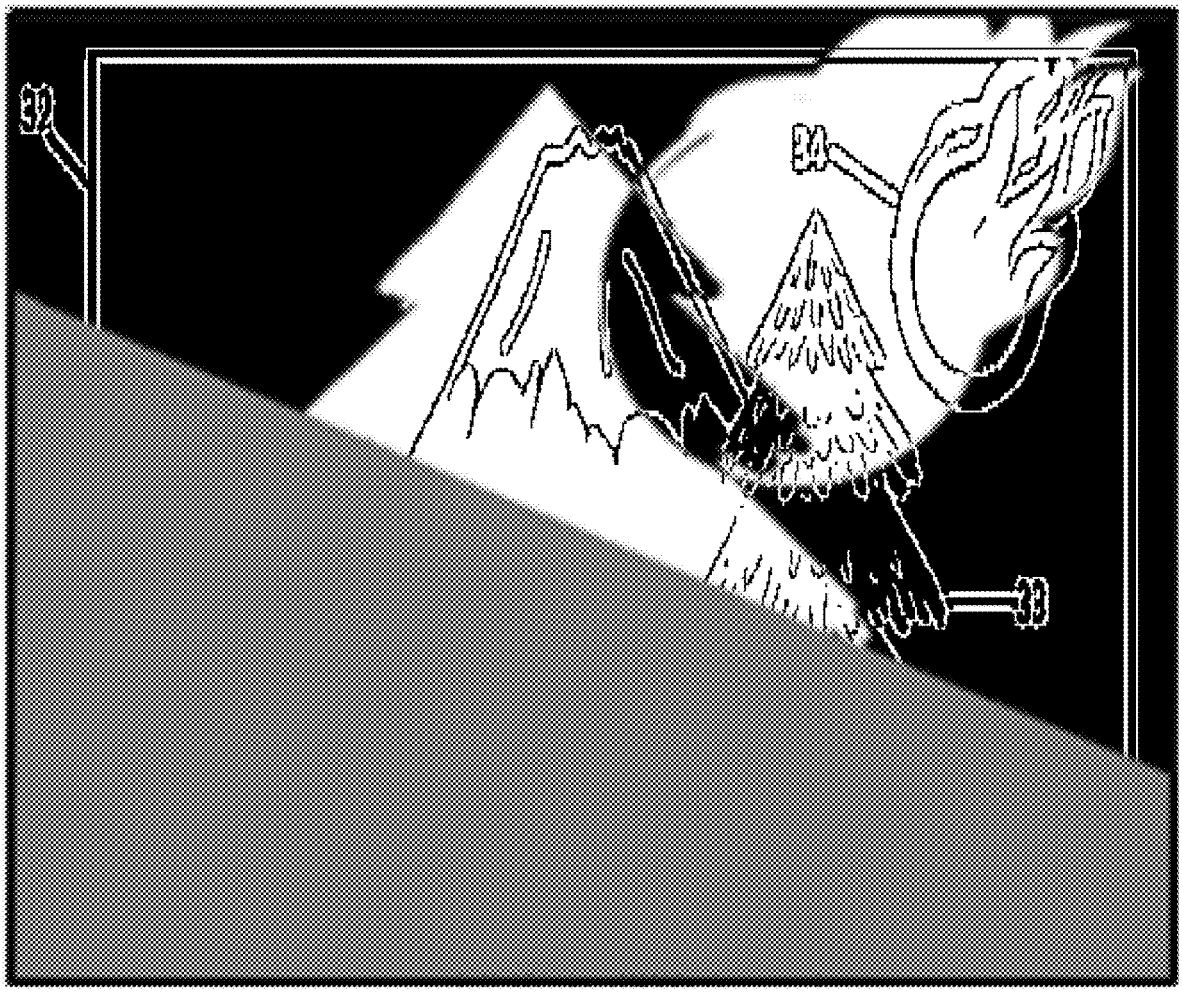
FIG. 13 illustrates the low contrast problem

FIG. 13 visualizes the low contrast problem. FIG. 13 shows the result of drawing FIG. 12A and FIG. 12B using the select function from FIG. 12C. Note that because of low contrast the edge information can become indiscernible in the bottom left region of the image.

Figure 14A:
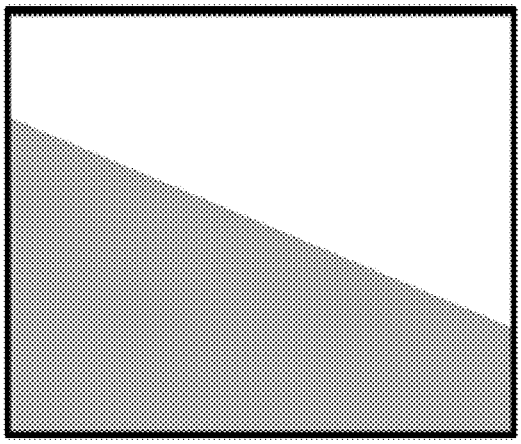
FIG. 14A illustrates an application with two colors
Figure 14B:
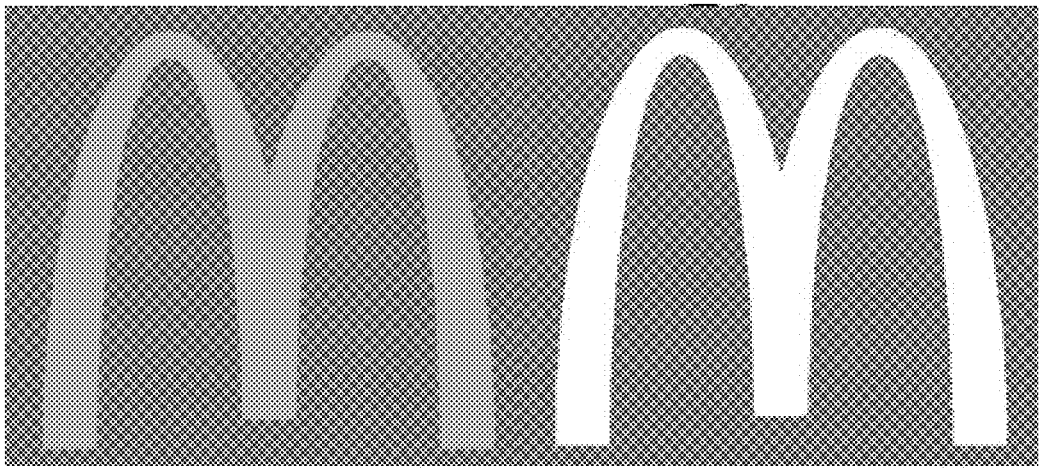
FIG. 14B illustrates a layer of context2 with two colors
Figure 14C:
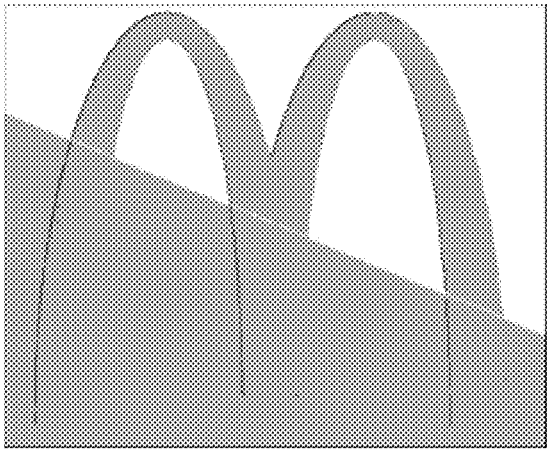
FIG. 14C illustrates FIG. 14B drawn over FIG. 14A
Figure 14D:
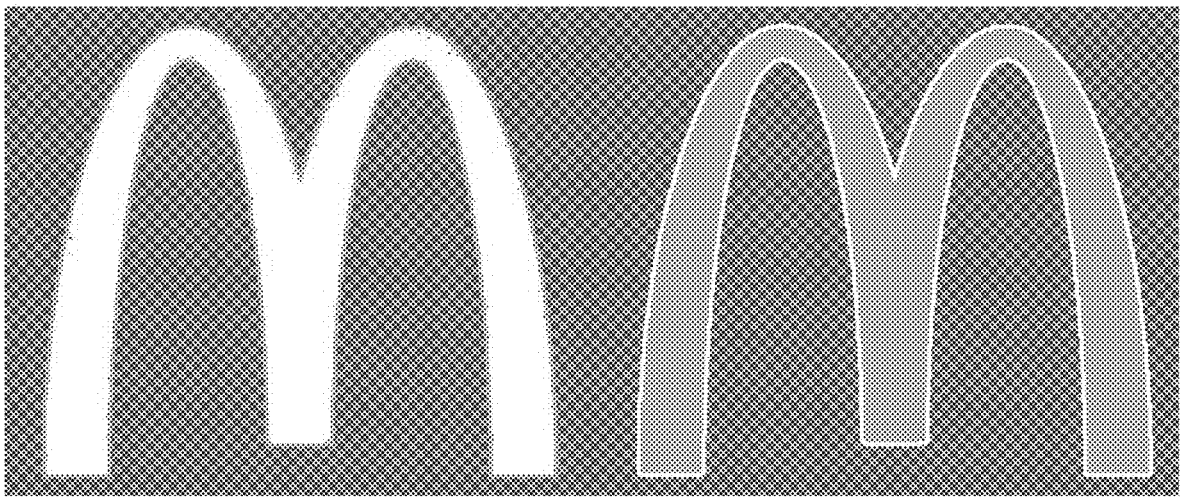
FIG. 14D illustrates FIG. 14B with a border
Figure 14E:
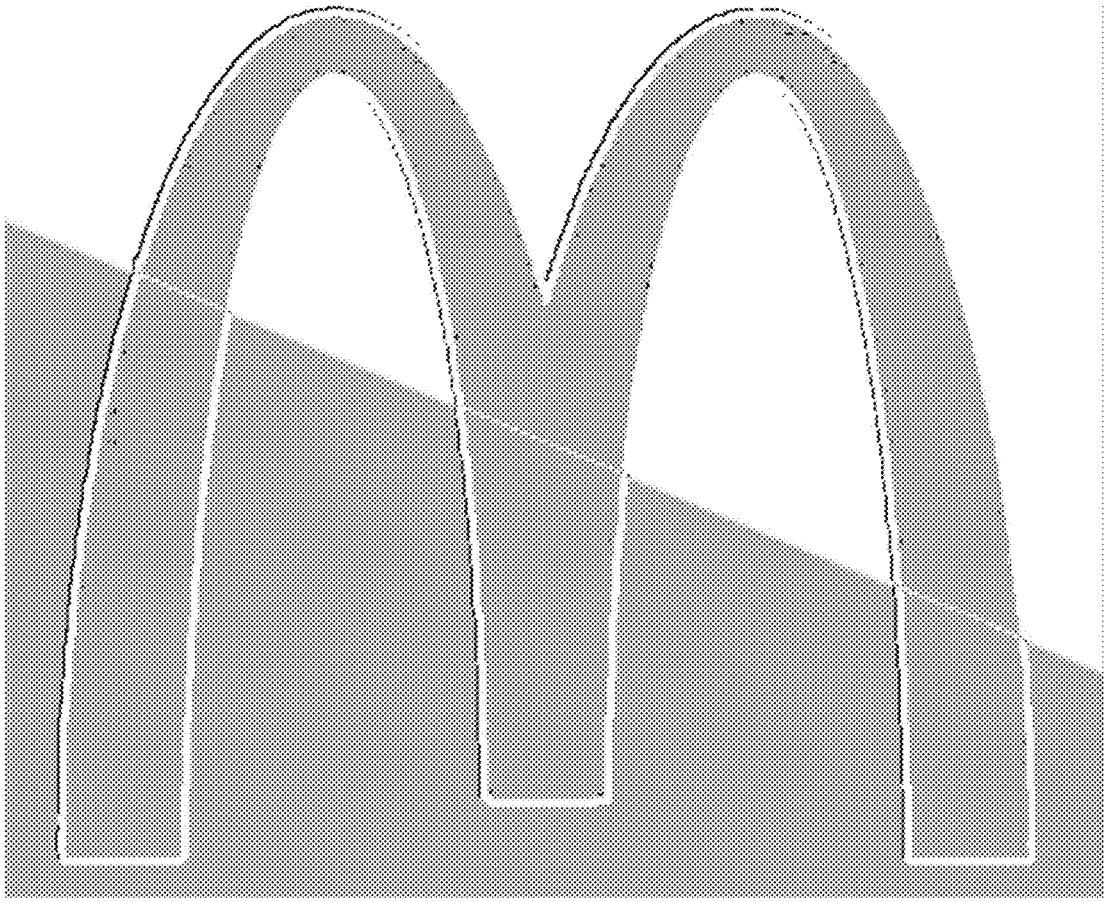
FIG. 14E illustrates FIG. 14D drawn over FIG. 14A

When the colors of the layers of context2 are 'close' to the colors of the application there is a low contrast problem at the intersection of context2 and context1. It becomes difficult to discern which pixels belong to context2 and which pixels belong to context1. FIG. 14A shows an application with two colors. FIG. 14B shows two layers of context2 with two colors, one of which is 'close' in color to one of the colors of FIG. 14A. FIG. 14C shows FIG. 14B drawn over FIG. 14A using the algorithm of FIG. 10. Note that the low contrast makes it difficult to discern which pixels belong to context2 and which pixels belong to context1. A possible solution to this problem is to ensure that the images of context2 are drawn with a high contrast border as shown in FIG. 14D. FIG. 14E shows FIG. 14D drawn over FIG. 14A using the algorithm of FIG. 10. Note that even when the colors are 'close' the border provides discernment between context1 and context2. Note that it is difficult to discern between context1 and the border color of context2, but, all of the non-border information from FIG. 14D is discernable.

In some embodiments this invention can display multiple advertisements concurrently with an application. For instance, context2 could consist of 6 or more different banner advertisements that are tiled. Context1 could be displayed as filtered images of multiple advertisements.

In some embodiments this invention can display advertisements moving, rotating, scaling, etc. in the display.

In an embodiment, a computer-readable storage medium may be RAM, ROM, EEPROM, CD-ROM or other optical disk storage, magnetic disk storage or other magnetic storage devices, or any other hardware medium that can be used to carry or store desired program code means in the form of instructions or data structures and that can be accessed by a general-purpose or special-purpose computer, or a general-purpose or special-purpose processor.

It would be understood that the invention described herein requires at least a controller capable of executing image processing programs and a memory to store programs executed by the controller and images processed by the controller. The controller may comprise a central processing unit (CPU), a computer, a computer unit, a data processor, a microcomputer, microelectronics device, or a microprocessor. The memory includes, but is not limited to a read/write memory, read only memory (ROM), random access memory (RAM), DRAM, SRAM etc.

What has been described above includes examples of the subject invention. It is, of course, not possible to describe every conceivable combination of components or methodologies for purposes of describing the subject invention, but one of ordinary skill in the art may recognize that many further combinations and permutations of the subject invention are possible. Accordingly, the subject invention is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While embodiments of the present disclosure have been particularly shown and described with reference to exemplary embodiments thereof, it will be understood by those of ordinary skill in the art that various changes in form and details may be made therein without departing from the spirit and scope of the present invention as defined by the following claims.

LIST OF NUMBERED ITEMS

1) Display
2) banner ad
3) application
4) interstitial ad
5) application w/in-app ad
6) actor/entity allocated to displaying ads
7) ad displayed on actor/entity
8) ad full screen
9) PacMan character
10) Checkerboard transparent pixels
11) Bounding box
31) Man actor
32) Background image
33) Tree entity
34) Comet actor
35) Painter's algorithm
36) Retrieve next ad
37) Calculate next scene
38) Preprocess step
39) Modified painter's algorithm
40) Offscreen buffer
41) Test if next ad received
42) Scaling step
51) Draw Ad to Display
56) Draw OSB to Display
74) Man actor edge information
76) Tree entity edge information
77) Comet actor edge information

What is claimed is:

1. An image processing device, comprising: a processor coupled to a memory; and a display screen, wherein the processor is configured to process a plurality of media formats stored in the memory, each of the plurality of media formats is made up of a digital image layer that includes at least non-transparent pixels; the processor configured to execute the following: set the non-transparent pixels in each of the digital image layer of the plurality of media formats to a contrast state by application of one or more image filters of a plurality of image filters; set pixels stored in an off-screen data buffer of the memory to pixels corresponding to a predetermined color scheme; apply an image function to each of the plurality of media formats drawn successively to the off-screen data buffer so as to allow the plurality of overlapping media formats to be displayed on the display screen as see through, wherein the one or more image filters manipulates the non-transparent pixels in each of the digital image layer of the plurality of media formats to a black and white version, and wherein the plurality of image filters comprise multiple contrast filters applied successively and include a grayscale filter, a threshold filter, an edge detection filter, a sharpen filter, a blur filter, and an assign bins filter.

2. The image processing device as set forth in claim 1, wherein the processor is further configured to simultaneously draw the off screen buffer and another media format to the display screen by using the same pixels and by displaying the true color information of the another media format and overlapping the edge information of the pixels in the off screen buffer as the image function applied to the true colors of the another media format.

3. The image processing device as set forth in claim 2, wherein the image function being a replacing function that blends the pixels in the off-screen data buffer with the non-transparent pixels in the digital image layer to generate new pixel values in the off-screen data buffer.

4. The image processing device as set forth in claim 3, wherein the new pixel values are generated by replacing every pixel in the digital image layer with the pixels of the another digital image while drawing the digital image layer to the off-screen buffer.

5. The image processing device as set forth in claim 1, wherein the plurality of media formats include any digitally displayable information including images, videos, animations, graphs and text.

6. The image processing device as set forth in claim 1, wherein the contrast state being a white RGB color scheme.

7. The image processing device as set forth in claim 1, wherein the contrast state being one of a plurality of RGB color schemes.

8. The image processing device as set forth in claim 1, wherein the one or more image filters comprises one or more simple contrast filters which set the non-transparent pixels to black or white by using an edge detection algorithm.

9. A non-transitory computer-readable storage medium with an executable program stored thereon, wherein the program instructs a computer to perform the following steps: processing a plurality of media formats where each of the plurality of media formats is made up of a digital image layer that includes at least non-transparent pixels; setting the non-transparent pixels in each of the digital image layer of the plurality of media formats to a contrast state by application of one or more image filters of a plurality of image filters; setting pixels stored in an off-screen data buffer to pixels corresponding to a predetermined color scheme; applying an image function to each of the plurality of media formats drawn successively to the off-screen data buffer so as to allow the plurality of overlapping media formats to be displayed on the display screen as see through, wherein the one or more image filters manipulates the non-transparent pixels in each of the digital image layer of the plurality of media formats to a black and white version, and wherein the plurality of image filters comprise multiple contrast filters applied successively and include a grayscale filter, a threshold filter, an edge detection filter, a sharpen filter, a blur filter, and an assign bins filter.

10. The non-transitory computer-readable storage medium as set forth in claim 9, further comprising the step of: simultaneously drawing the off screen buffer and another media format to a display screen by using the same pixels and by displaying the true color information of the another media format and overlapping the edge information of the pixels in the off screen buffer as the image function applied to the true colors of the another media format.

11. The non-transitory computer-readable storage medium as set forth in claim 10, wherein the image function being a replacing function that replaces the pixels in the off-screen data buffer with the non-transparent pixels in the digital image layer to generate new pixel values in the off-screen data buffer.

12. The non-transitory computer-readable storage medium as set forth in claim 11, wherein the new pixel values are generated by replacing every pixel in the digital image layer with the pixels of the another digital image while drawing the digital image layer to the off-screen buffer.

13. The non-transitory computer-readable storage medium as set forth in claim 9, wherein the one or more image filters comprises one or more simple contrast filters which set the non-transparent pixels to black or white by using an edge detection algorithm.

14. An image processing method, comprising: processing, using a central processing unit, a plurality of media formats stored in a memory, each of the plurality of media formats is made up of a digital image layer that includes at least non-transparent pixels; setting the non-transparent pixels in each of the digital image layer of the plurality of media formats to a contrast state by application of one or more image filters of a plurality of image filters; setting pixels stored in an off-screen data buffer of the memory to pixels corresponding to a predetermined RGB color scheme; applying an image function to each of the plurality of media formats drawn successively to the off-screen data buffer so as to allow the plurality of overlapping media formats to be displayed on the display screen as see through, wherein the one or more image filters manipulates the non-transparent pixels in each of the digital image layer of the plurality of media formats to a black and white version, and wherein the plurality of image filters comprise multiple contrast filters applied successively and include a grayscale filter, a threshold filter, an edge detection filter, a sharpen filter, a blur filter, and an assign bins filter.

15. The image processing device as set forth in claim 14, further comprising the step of: simultaneously drawing the off screen buffer and another media format to the display screen by using the same pixels and by displaying the true color information of the another media format and overlapping the edge information of the pixels in the off screen buffer as the image function applied to the true colors of the another media format.

16. The image processing method as set forth in claim 15, wherein the image function being a replacing function that replaces the pixels in the off-screen data buffer with the non-transparent pixels in the digital image layer to generate new pixel values in the off-screen data buffer.

17. The image processing method as set forth in claim 16, wherein the new pixel values are generated by replacing every pixel in the digital image layer with the pixels of the another digital image while drawing the digital image layer to the off-screen buffer.

18. The image processing method as set forth in claim 15, wherein the image function comprises one of edge detection, threshold, grayscale, sepia, blur, brightness, contrast, invert, saturate, opacity, and blending.

19. The image processing method as set forth in claim 14, wherein the contrast state being a white RGB color scheme.

20. The image processing method as set forth in claim 14, wherein the contrast state being one of a plurality of RGB color schemes including a white RGB color scheme.

21. The image processing method as set forth in claim 14, wherein the predetermined color scheme being a white RGB color scheme.

22. The image processing method as set forth in claim 14, wherein the plurality of media formats include any digitally displayable information including images, videos, animations, graphs and text.

23. The image processing method as set forth in claim 14, wherein the one or more image filters comprises one or more simple contrast filters which set the non-transparent pixels to black or white by using an edge detection algorithm.

* * * * *